United States Patent [19]

Kitatani et al.

[11] Patent Number: 4,756,993

[45] Date of Patent: Jul. 12, 1988

[54] ELECTROPHOTOGRAPHIC PHOTORECEPTOR WITH LIGHT SCATTERING LAYER OR LIGHT ABSORBING LAYER ON SUPPORT BACKSIDE

[75] Inventors: Katsugi Kitatani; Kenji Sano; Keishi Kato; Shigeru Ohno, all of Kanagawa, Japan

[73] Assignee: Fuji Photo Film Co., Ltd., Kanagawa, Japan

[21] Appl. No.: 7,215

[22] Filed: Jan. 27, 1987

[30] Foreign Application Priority Data

Jan. 27, 1986 [JP] Japan ..... 61-13650
Jan. 29, 1986 [JP] Japan ..... 61-16674

[51] Int. Cl.[4] ..... G03G 5/10

[52] U.S. Cl. ..... 430/69; 430/4; 430/945; 430/950; 430/522

[58] Field of Search ..... 430/4, 945, 950, 56, 430/522, 69

[56] References Cited

U.S. PATENT DOCUMENTS 3,398,145 8/1968 Bailey ..... 430/522 X
4,416,963 11/1983 Takimoto et al. ..... 430/950 X
4,618,552 10/1986 Tanaka et al. ..... 430/4 X

*Primary Examiner*—J. David Welsh
*Attorney, Agent, or Firm*—Sughrue, Mion, Zinn, Macpeak, and Seas

[57] ABSTRACT

An electrophotographic photoreceptor is disclosed, comprising a light-transmitting conductive support having provided thereon a light-transmitting electrophotographic photosensitive layer, said support having further provided on the side opposite to the photosensitive layer a light scattering layer comprising an inorganic fine powder and a binder or a light absorbing layer comprising a near infrared absorbing dye and a binder. The photoreceptor can provide a sharp image free from interference fringe-like non-uniformity of density even when a laser is used as a light source of exposure.

13 Claims, No Drawings

ELECTROPHOTOGRAPHIC PHOTORECEPTOR WITH LIGHT SCATTERING LAYER OR LIGHT ABSORBING LAYER ON SUPPORT BACKSIDE

FIELD OF THE INVENTION

This invention relates to a ligh-transmitting electrophotographic photoreceptor suitable for the production of microfilms and the like. More particularly, it relates to a light-transmitting electrophotographic photoreceptor suitable for recording using, e.g., a semiconductor laser.

BACKGROUND OF THE INVENTION

Methods of image formation by electrophotography include a method comprising forming a toner image on an electrophotographic photoreceptor, such as a selenium drum, and transferring the toner image to paper, a method comprising forming a toner image on a recording material comprising a support, e.g., paper, film, etc., having provided thereon a photoconductive layer, and the like.

Through extension of application of these image formation methods, an electrophotographic photoreceptor comprising a light-transmitting conductive support having provided thereon a transparent organic photoconductive layer has recently been developed as a recording material in the field of microfilms and the like (see *Optical Eng.,* Vol. 20, No. 3, 365 (1981), and Japanese Patent Application (OPI) No. 238841/86 (the term "OPI" as used herein means "unexamined published application")). According to this system, a toner image is electrophotographically formed on the light-transmitting photoreceptor, and the image recorded can be seen whenever necessary by means of transmitted light by enlarging projection or making copies.

On the other hand, an electrophotographic system using a laser as a light source has been developed recently. Lasers used include gas lasers, e.g., an He-Ne laser, etc., and semiconductor lasers, e.g., a Ga-Al-As laser, etc. The semiconductor lasers have great advantages over the gas lasers, such as a small size, low cost, capability of direct modulation, and the like.

However, such a laser, when applied as a light source for recording on the aforesaid light-transmitting electrophotographic photoreceptor, causes potential unevenness like interference fringes on the surface of the receptor, which results in non-uniform density upon toner development of the electrostatic latent image. In order to prevent generation of similar interference fringes on electrophotographic photoreceptors using an opaque support for a laser beam printer, it has been proposed to use a conductive support having a roughened surface as disclosed in Japanese Patent Application (OPI) Nos. 162975/83, 171057/83 and 112049/85; to provide a subbing layer having a rough surface with no gloss between a conductive support and a photosensitive layer as disclosed in Japanese Patent Application (OPI) No. 172047/85; or to provide a subbing layer having dispersed therein titanium black between a conductive support and a photosensitive layer as disclosed in Japanese Patent Application (OPI) No. 184258/85. However, provision of such a subbing layer between a conductive layer and a conductive support of the above-described light-transmitting photoreceptor does not produce fully satisfactory effects. In particular, the presence of a titanium black-dispersed layer rather causes a hinderance to reading of the recorded image by transmitted light.

SUMMARY OF THE INVENTION

The inventors have conducted extensive studies on causes of the above-described interference fringes. As a result, it has been proved that since semiconductor lasers are coherent beams of light and many of them have wavelengths in the near infrared region of 750 nm or more, when a laser beam enters into the inside of the light-transmitting photoreceptor composed of the photosensitive layer and the conductive support having such a thickness for use as recording materials, for example, microfilms, it reflects mainly on the back side of the support, and the reflected light interferes with the incident light on the surface of the receptor, to thereby produce interference fringes. Hence, the inventors have found that the above-described problem can be solved by providing a light scattering layer or a light absorbing layer on the back side of the support as a layer for prevention of reflection.

Accordingly, one object of this invention is to provide a light-transmitting electrophotographic photoreceptor suitable for recording by a laser.

A particular object of this invention is to provide a light-transmitting electrophotographic photoreceptor which can form a sharp image without generating interference fringes on recording.

The present invention relates to an electrophotographic photoreceptor comprising a light-transmitting conductive support having provided thereon a light-transmitting electrophotographic photosensitive layer, wherein said support is further provided on the side opposite to the photosensitive layer with a light scattering layer comprising an inorganic fine powder and a binder or a light absorbing layer comprising a near infrared absorbing dye and a binder.

DETAILED DESCRIPTION OF THE INVENTION

The light-transmitting conductive support which can be used in the present invention includes transparent thermoplastic resin films having a conductive coating. The resins to be used include polyesters, polycarbonates, polyamides, acrylic resins, polyamide-imide resins, polystyrene, polyacetals, polyolefins, etc.

The conductive coating can be formed by, for example, vacuum evaporation of a metal, e.g., aluminum, gold, palladium, indium, etc., vacuum evaporation of a metal oxide, e.g., $In_2O_3$, $SnO_2$, etc., coating of a dispersion of a metal powder or a metal oxide, e.g., $SnO_2$, in a polymer binder, coating of a solution of an organic quaternary salt compound, etc., in a polymer binder, coating of an acetonitrile solution of copper iodide, or the like technique.

The electrophotographic photosensitive layer which can be used in the invention is an organic photoconductive layer composed of an organic photoconductive substance. The photosensitive layer should have light-transmitting properties that would not cause a hinderance to reading of a toner image formed thereon by means of transmitted light.

Many known organic photoconductive substances can be applied to the photoreceptors of the present invention. Of these, examples of high-molecular organic photoconductive substances are polyvinylcarbazole and its derivatives described in U.S. Pat. No. 3,037,861 and Japanese Patent Publication Nos. 10966/59, 19751/67, and 25230/67; vinyl polymers, e.g., polyvinylpyrene, poyvinylanthracene, poly-2-vinyl-4-(4'-dimethylaminophenyl)-5-phenyl-oxazole, poly-3-vinyl-N-ethylcarbazole, etc., described in Japanese Patent Publication No. 18674/68 and 19192/68; polyacenaphthylene, polyindene, acenaphthylene-styrene copolymers, etc. described in Japanese Patent Publication No. 19193/68; condensed resins, e.g., a pyrene-formaldehyde resin, a bromopyrene-formaldehyde resin, an ethylcarbazole-formaldehyde resin, etc., described in Japanese Patent Publication No. 13940/81; and various triphenylmethane polymers described in Japanese Patent Application (OPI) Nos. 90883/81 and 161550/81. Examples of low-molecular organic photoconductive substances include triazole derivatives described in U.S. Pat. No. 3,112,197; oxadiazole derivatives described in U.S. Pat. No. 3,189,447; imidazole derivatives described in Japanese Patent Publication No. 16096/62; polyarylalkane derivatives described in U.S. Pat. Nos. 3,615,402, 3,820,989, and 3,542,544, Japanese Patent Publication Nos. 555/70 and 10983/76, and Japanese Patent Application (OPI) Nos. 93224/76, 17105/80, 4148/81, 108667/80, 156953/80, and 36656/81; pyrazoline derivatives and pyrazolone derivatives described in U.S. Pat. Nos. 3,180,729 and 4,278,746, and Japanese Patent Application (OPI) Nos. 88064/80, 88065/80, 105537/84, 51086/80, 80051/81, 88141/81, 45545/82, 112637/79, and 74546/80; phenylenediamine derivatives described in U.S. Pat. No. 3,615,404, Japanese Patent Publication No. 10105/76, Japanese Patent Application (OPI) Nos. 83435/79, 110836/79, and 119925/79, and Japanese Patent Publication Nos. 3712/71 and 28336/72; arylamine derivatives described in U.S. Pat. No. 3,567,450, Japanese Patent Publication No. 35702/75, West German Patent (DAS) No. 1,110,518, U.S. Pat. Nos. 3,180,703, 3,240,597, 3,658,520, 4,232,103, 4,175,961, and 4,012,376, Japanese Patent Application (OPI) Nos. 144250/80 and 119132/81, Japanese Patent Publication No. 27577/64, and Japanese Patent Application (OPI) No. 22437/81; amino-substituted chalcone derivatives described in U.S. Pat. No. 3,526,501; N,N-bicarbazyl derivatives described in U.S. Pat. No. 3,542,546; oxazole derivatives described in U.S. Pat. No. 3,257,203; styrylanthracene derivatives described in Japanese Patent Application (OPI) No. 46234/81; fluorenone derivatives described in Japanese Patent Application (OPI) No. 110837/79; hydrazone derivatives described in U.S. Pat. Nos. 3,717,462 and 4,150,987, and Japanese Patent Application (OPI) Nos. 52063/80, 52064/80, 46760/80, 85495/80, 11350/82, 148749/82, and 64244/82; and benzidine derivatives described in Japanese Patent Publication No. 11546/64 and U.S. Pat. Nos. 4,265,990 and 4,047,949.

In the case of using low-molecular weight compounds as organic photoconductive substance, appropriate high-molecular weight compounds having film-forming properties (i.e., polymeric compounds) can be used as binders. Examples of such polymeric compounds include polyamide, polyurethane, polyester, epoxy resins, polyketone, styrene polymers or copolymers, poly-N-vinylcarbazole, polycarbonate, polyester carbonate, polysulfone, a vinyl chloride resin, a vinylidene chloride resin, a vinyl acetate resin, an acrylic resin, etc. These polymeric compounds may also be used, if desired, in the case where the organic photoconductive substance is a high polymer having per se film-forming properties.

If desired, the electrophotographic photosensitive layer of the invention can contain a sensitizing dye.

The sensitizing dye to be added can be selected appropriately from among various known sensitizing dyes, such as those described in *Society of Photographic Scientists and Engineers,* Vol. 19, 60–64 (1975), *Applied Optics,* Suppl. Vol. 3, 50 (1969), U.S. Pat. Nos. 3,037,861, 3,250,615, and 3,712,811, British Pat. No. 1,353,264, *Research Disclosure,* RD No. 10938 (May, 1973), U.S. Pat. Nos. 3,141,700 and 3,938,994, and Japanese Patent Application (OPI) Nos. 14560/81, 14561/81, 29586/81, 29587/81, 65885/81, 114259/80, and 35141/81; and other dyes capable of increasing sensitivities of organic photoconductive substances.

When the photoreceptors according to the present invention are applied to a recording system using a semiconductor laser as a light source, the organic photoconductive layer should have its main absorption in the near infrared region of 750 nm or more, and desirably exhibits high sensitivity in this region. To obtain this effect, various sensitizing dyes can be employed, such as substituted arylbenzo(thio)pyrylium salts described in U.S. Pat. No. 3,881,924; trimethinethiapyrylium salts described in U.S. Pat. No. 4,327,169; pyrylium compounds described in Japanese Patent Application (OPI) Nos. 181051/83, 220143/83, 41363/84, 84248/84, 84249/84, 146063/84 and 146061/84; and cyanine dyes described in Japanese Patent Application (OPI) No. 216146/84. In particular, pentamethinethiopyrylium salts, etc. described in U.S. Pat. No. 4,283,475 or combinations or pyrylium compounds and amide compounds described in Japanese Patent Application (OPI) No. 213197/85 are preferably used.

The photosensitive layer of the present invention can further contain a chemical sensitizer, such as electron-attractive compounds, e.g., trinitrofluorenone, chloranil, tetracyanoethylene, etc., compounds described in Japanese Patent Application (OPI) Nos. 65439/83 and 102239/83, and the like.

If desired, the photosensitive layer can furthermore contain various additives, such as reinforcing agents, plasticizers, curing catalysts, crosslinking agents, fluorine-containing surface active agents, and the like.

A characteristic feature of this invention lies in that a light scattering layer or a light absorbing layer is provided on the back side of the light-transmitting support on which the above-described electrophotographic photosensitive layer is formed. By providing a light scattering layer or a light absorbing layer on the back side of the support, generation of interference fringes upon image recording by means of a semiconductor laser can be prevented effectively.

The light scattering layer according to the present invention comprises a binder having dispersed therein a fine powder of a metal oxide or other inorganic material. The fine powders to be dispersed include metal oxides, e.g., zinc oxide, titanium oxide, aluminum oxide, silicon oxide, zirconium oxide, antimony oxide, tin oxide, indium oxide, etc.; and inorganic materials, e.g., silicon carbide, titanium carbide, boron nitride, tantalum nitride, titanium nitride, magnesium fluoride, cerium fluoride, etc.

The light scattering layer of the invention can be formed by dispersing at least one of these fine powders in a solution of a binder in an appropriate solvent and coating the dispersion on th back side of the conductive support, i.e., the side opposite to the photosensitive layer, followed by drying. The solvent to be used for dissolving the binder includes water, alcohols, methyl cellosolve, benzene, toluene, xylene, chlorobenzene, dichloromethane, dichloroethane, trichloroethane, cyclohexanone, tetrahydrofuran, dioxane, acetone, methyl ethyl ketone, etc., and mixtures thereof. The formation of the light scattering layer may be either before or after the formation of the photosensitive layer, or these two layers may be formed simultaneously.

Binders to be used in the light scattering layer include hydrophilic colloidal compounds, e.g., gelatin, etc., and various high polymeric compounds, e.g., polyamide, polyurethane, polyester, an epoxy resin, polyketone, a styrene polymer or copolymer, poly-N-vinylcarbazole, polycarbonate, polyester carbonate, polysulfone, a vinyl chloride resin, a vinylidene chloride resin, a vinyl acetate resin, an acrylic resin, etc.

The light scattering layer according to this invention should have light-transmitting properties so as not to cause a hinderance to reading of a toner image formed on the photosensitive layer by means of transmitted light. In other words, the light scattering layer should satisfy both the requirements that it prevents a laser ray for recording from reflecting from the back side of a support and that it transmits light for reading out. These requirements can be fulfilled by selections of the particle size and concentration of dispersed fine powder, the thickness of the light scattering layer, and the like.

The fine powder preferably has a particle size of from 7 to 200 mμ. The content of the fine powder is preferably from 1 to 70% by weight, and more preferably from 1 to 20% by weight, based on the total weight of the light scattering layer. The thickness of the light scattering layer preferably ranges from 1 to 20 μm, and more preferably from 1 to 5 μm.

The light-absorbing layer according to the present invention comprises a dye having absorption in the near infrared region and a binder. Such dyes include cyanine dyes as described in Japanese Patent Application (OPI) Nos. 125246/83, 84356/84, 202829/84, and 78787/85; methine dyes as described in Japanese Patent Application (OPI) Nos. 173696/83, 181690/83, and 194595/83; naphthoquinone dyes as described in Japanese Patent Application (OPI) Nos. 112793/83, 224793/83, 48187/84, 73996/84, 52940/85, and 63744/85; squalilium dyes as described in Japanese Patent Application (OPI) No. 112792/83; cyanine dyes as described in British Pat. No. 434,875; and the like. In addition, the above-recited sensitizing dyes may also be used for the light absorbing layer. Among these dyes, preferred are those represented by formula (I) as disclosed in Japanese Patent Application No. 174940/85 (corresponding to U.S. patent application Ser. No. 894,017) and formula (II) as disclosed in Japanese Patent Application No. 217315/85 (corresponding to U.S. patent application Ser. No. 913,278) shown below. Formula (I) is represented by

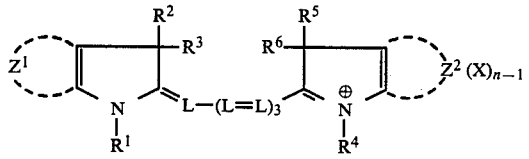

wherein $R^1$, $R^2$, $R^3$, $R^4$, $R^5$, and $R^6$ (which may be the same or different) each represents a substituted or unsubstituted alkyl group; $Z^1$ and $Z^2$ each represents a non-metallic atomic group forming a substituted or unsubstituted benzene or naphthalene condensed ring; L represents a substituted or unsubstituted methine group; X represents an anion; and n represents 1 or 2; when n is 1, the compound (I) is an inner salt; with proviso that at least one of $R^1$, $R^2$, $R^3$, $R^4$, $R^5$, $R^6$, $Z^1$, and $Z^2$ has an acid radical as a substituent.

Formula (II) is represented by

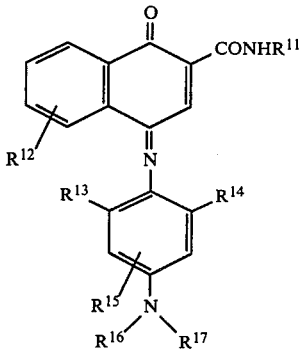

wherein $R^{11}$ represents a substituted or unsubstituted alkyl group, a substituted or unsubstituted aryl group, or a substituted or unsubstituted heterocyclic group; $R^{12}$ and $R^{15}$ (which may be the same or different) each represents a hydrogen atom or a group capable of substituting for a hydrogen atom; $R^{13}$ and $R^{14}$ (which may be the same or different) each represents a hydrogen atom, a halogen atom, a substituted or unsubstituted alkoxy group, or a substituted or unsubstituted alkyl group provided that $R^{13}$ and $R^{14}$ do not simultaneously represent a hydrogen atom; and $R^{16}$ and $R^{17}$ (which may be the same or different) each represent a substituted or unsubstituted alkyl group, a substituted or unsubstituted aryl group, an acyl group, or a sulfonyl group, or $R^{16}$ and $R^{17}$ together form a non-metallic 5- or 6-membered ring.

More specifically, in formula (I), at least one, preferably 2 or more, and more preferably from 4 to 6, of $R^1$, $R^2$, $R^3$, $R^4$, $R^5$, $R^6$, $Z^1$, and $Z^2$ should have an acid radical, e.g., a sulfonic acid group and a carboxylic acid group. Particularly preferred dyes of formula (I) contain from 4 to 6 sulfonic acid groups per molecule. The term "sulfonic acid group" or "carboxylic acid group" as used herein means a "a sulfo group or a salt thereof" or "a carboxyl group or a salt thereof", respectively.

Specific examples of the anion as represented by X include a halogen ion (e.g., Cl, Br, etc.), a p-toluenesulfonate ion, an ethyl sulfate ion, etc.

The alkyl group as represented by $R^1$, $R^2$, $R^3$, $R^4$, $R^5$, or $R^6$ is preferably a lower alkyl group having from 1 to 5 carbon atoms, e.g., a methyl group, an ethyl group, an n-propyl group, an n-butyl group, an isopropyl group, an n-pentyl group, etc., which may be substituted with a sulfonic acid group, a carboxylic acid group, a hydroxyl group, etc. $R^1$ and $R^4$ each preferably represents a sulfo-substituted lower alkyl group having from 1 to 5 carbon atoms, e.g., a 2-sulfoethyl group, a 3-sulfopropyl group, a 4-sulfobutyl group, etc.

Substituents for the benzene or naphthalene condensed ring formed by $Z^1$ or $Z^2$ include a sulfonic acid group, a carboxylic acid group, a hydroxyl group, a halogen atom (e.g., a fluorine atom, a chlorine atom, a bromine atom, etc.), a cyano group, a substituted amino group (e.g., a dimethylamino group, a diethylamino group, an ethyl-4-sulfobutylamino group, a di(3-sulfopropyl)amino group, etc.), a substituted or unsubstituted alkyl group having from 1 to 5 carbon atoms (e.g., a methyl group, an ethyl group, a propyl group, a butyl group, etc.) which is bonded to the ring either directly or via a divalent linking group. Preferred examples of the substituent for such an alkyl group include a sulfonic acid group, a carboxylic acid group, a hydroxyl group, etc., and preferred divalent linking group include —O—, —NHCO—, —$NHSO_2$—, —NHCOO—, —NHCONH—, —COO—, —CO—, —$SO_2$—, etc.

Substituents for the methine group as represented by L preferably include a lower alkyl group having from 1 to 5 carbon atoms (e.g., a methyl group, an ethyl group, etc.), a halogen atom (e.g., a fluorine atom, a chlorine atom, a bromine atom, etc.), etc. The substituents of the methine groups as represented by L may be bonded together to form a 6-membered ring containing multiple methine groups, e.g., a 4,4-dimethylcyclohexene ring.

Specific but non-limiting examples of the dye compounds represented by formula (I) according to the present invention are shown below.

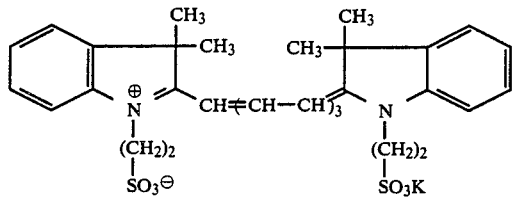

(I-1)

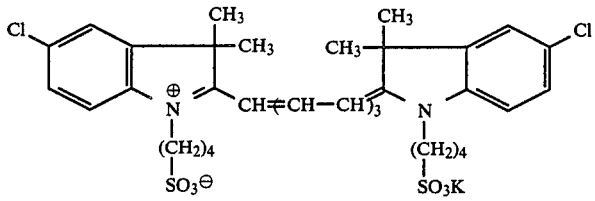

(I-2)

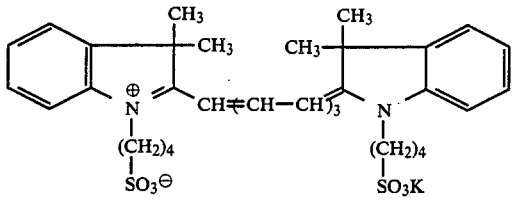

(I-3)

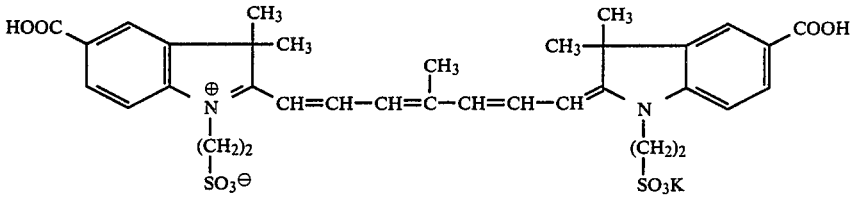

(I-4)

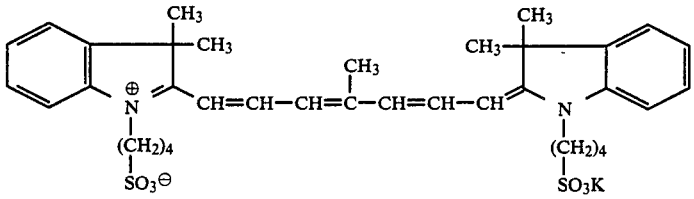

(I-5)

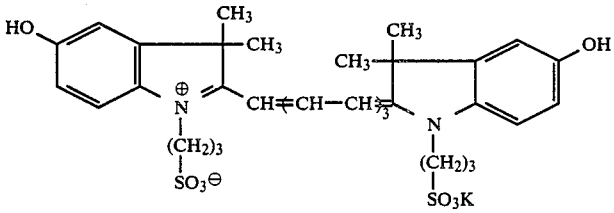

(I-6)

-continued
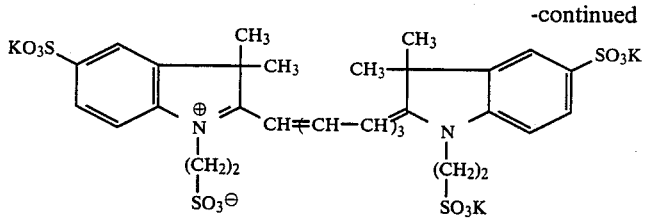
(I-7)
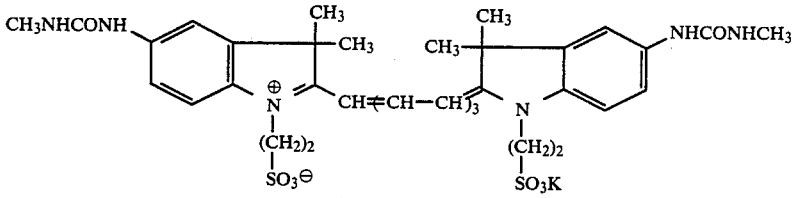
(I-8)
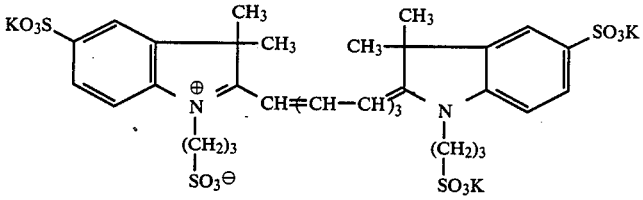
(I-9)
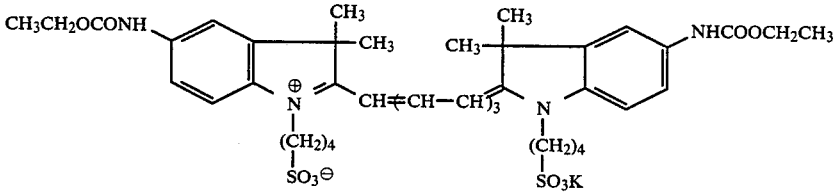
(I-10)
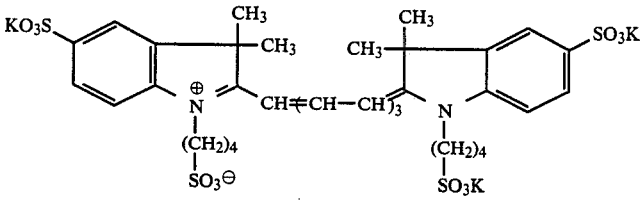
(I-11)
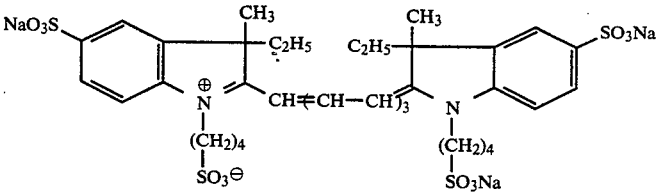
(I-12)
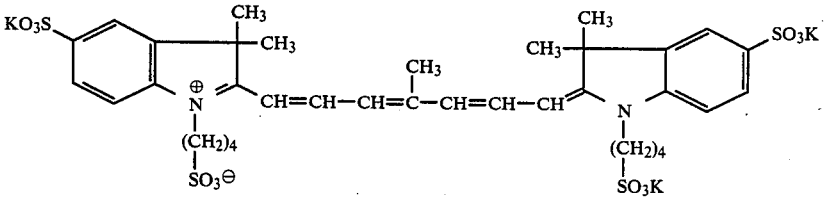
(I-13)
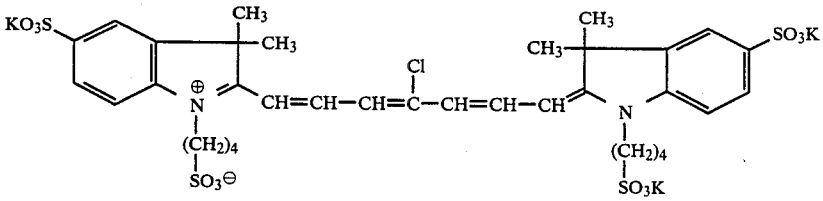
(I-14)

-continued
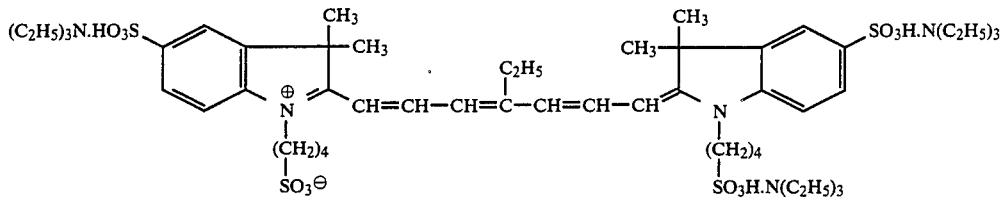
(I-15)
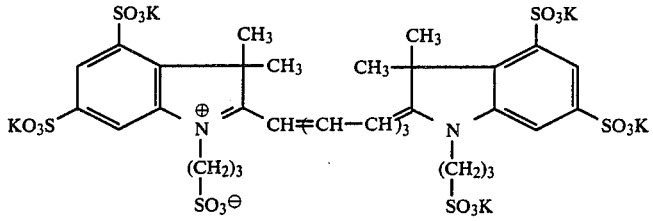
(I-16)
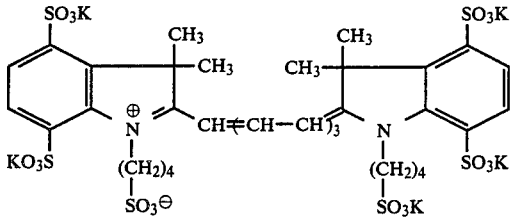
(I-17)
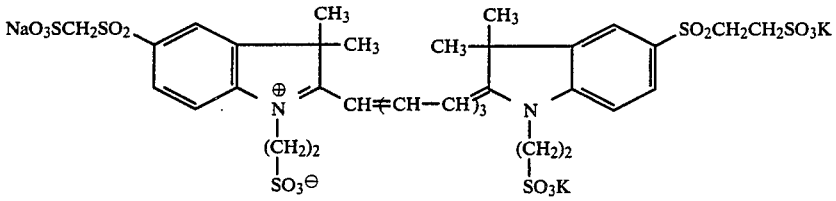
(I-18)
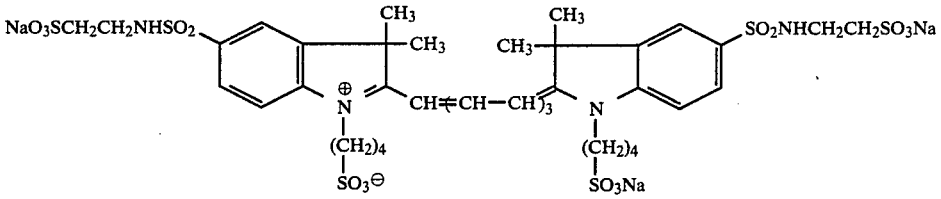
(I-19)
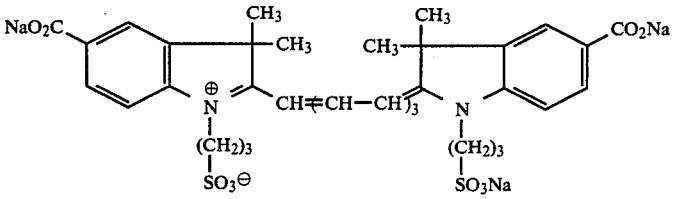
(I-20)
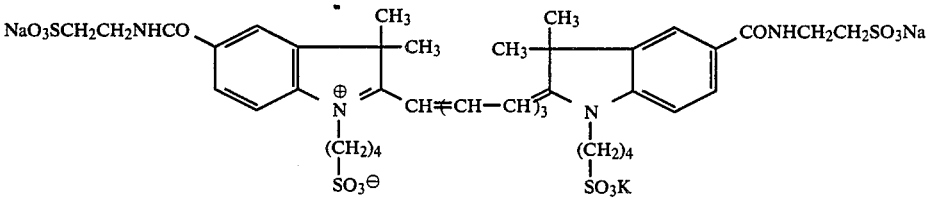
(I-21)
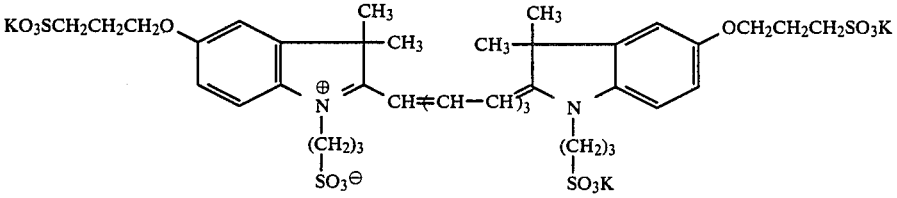
(I-22)

-continued
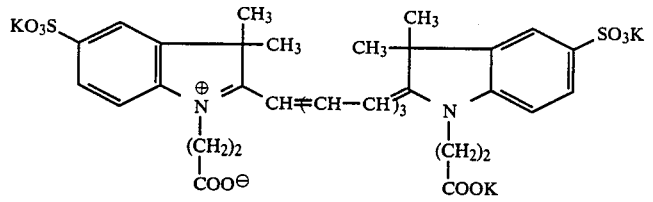
(I-23)
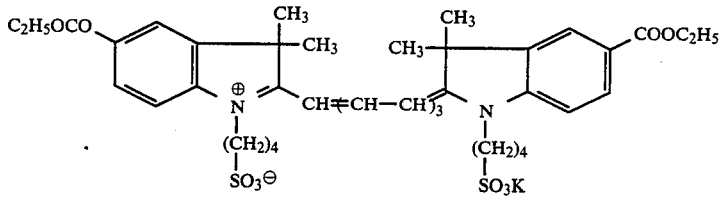
(I-24)
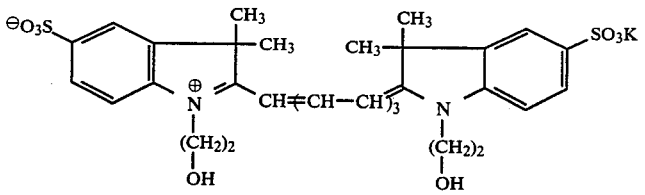
(I-25)
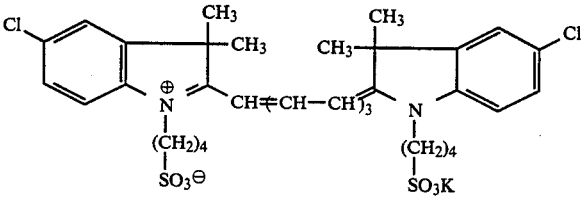
(I-26)
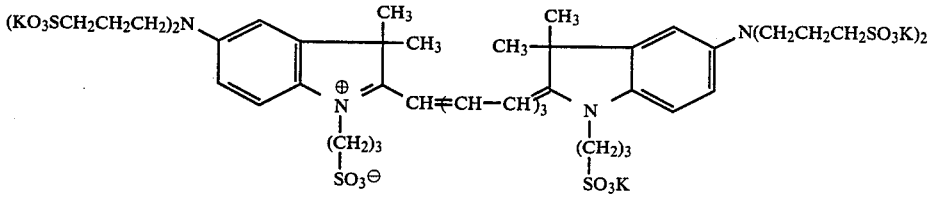
(I-27)
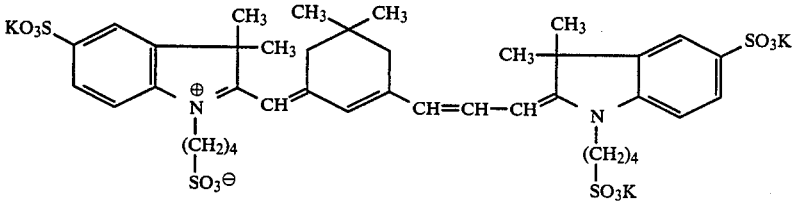
(I-28)
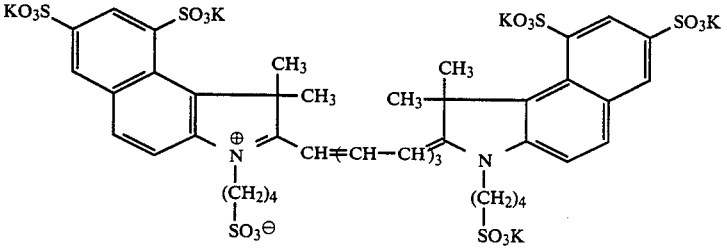
(I-29)

-continued

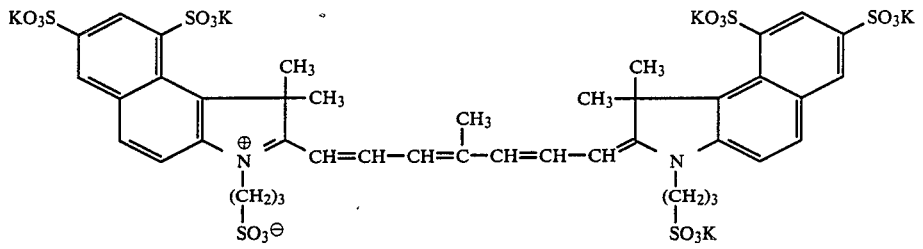

(I-30)

In formula (II), the alkyl groups as represented by $R^{11}$, $R^{13}$, $R^{14}$, $R^{16}$, and $R^{17}$ (which may be the same or different) preferably include lower alkyl groups having from 1 to 5 carbon atoms, e.g., a methyl group, an ethyl group, a propyl group, an isopropyl group, a t-butyl group, etc., which may be substituted with a sulfo group, a carboxyl group, a hydroxyl group, etc.

The aryl groups as represented by $R^{11}$, $R^{16}$, and $R^{17}$ (which may be the same or different) preferably include a substituted or unsubstituted phenyl group and a substituted or unsubstituted naphthyl group. Examples of substituents for the phenyl or naphthyl group are a sulfo group, a carboxyl group, a hydroxyl group, a cyano group, a halogen atom (e.g., a chlorine atom, a fluorine atom, etc.), an acyl group having from 2 to 5 carbon atoms (e.g., an acetyl group, a propionyl group, etc.), a sulfonyl group having from 1 to 5 carbon atoms (e.g., a methanesulfonyl group, an ethanesulfonyl group, a 2-sulfoethanesulfonyl group, a 3-sulfopropanesulfonyl group, etc.), a substituted or unsubstituted carbamoyl group having from 1 to 5 carbon atoms (e.g., a carbamoyl group, a methylcarbamoyl group, a 2-sulfoethylcarbamoyl group, a 2-carboxyethylcarbamoyl group, a 2-hydroxyethylcarbamoyl group, etc.), a substituted or unsubstituted sulfamoyl group having from 1 to 5 carbon atoms (e.g., a sulfamoyl group, a methylsulfamoyl group, an ethylsulfamoyl group, a 2-sulfoethylsulfamoyl group, a 2-carboxyethylsulfamoyl group, etc.), an alkoxycarbonyl group having from 1 to 5 carbon atoms (e.g., a methoxycarbonyl group, an ethoxycarbonyl group, a trichloroethoxycarbonyl group, a trifluoroethoxycarbonyl group, etc.), an alkoxy group having from 1 to 5 carbon atoms (e.g., a methoxy group an ethoxy group, etc.), an amino group (e.g., a dimethylamino group, a diethylamino group, etc.), etc.

The substituted or unsubstituted heterocyclic ring as represented by $R^{11}$ includes a monocyclic ring and a condensed ring, such as a 1,3-thiazole ring, a 1,3,4-triazole ring, a benzothiazole ring, a benzimidazole ring, a benzoxazole ring, a 1,3,4-thiadiazole ring, etc. Examples of substituents for the heterocyclic ring include a lower alkyl group, e.g., a methyl group, an ethyl group, etc., a lower alkoxy group, e.g., a methoxy group, an ethoxy group, etc., a sulfo group, a hydroxyl group, a carboxyl group, etc.

The group capable of substituting for a hydrogen atom, as represented by $R^{12}$ or $R^{15}$, includes a halogen atom (e.g., a fluorine atom, a chlorine atom, a bromine atom, etc.), a hydroxyl group, a sulfo group, a carboxyl group, a cyano group, or a substituted or unsubstituted alkyl group having from 1 to 5 carbon (e.g., a methyl group, an ethyl group, etc., which may be substituted with a sulfo group, a carboxyl group, a hydroxyl group, etc.) which is bonded either directly or via a divalent linking group, e.g., —O—, —NHCO—, —$NHSO_2$—, —NHCOO—, —NHCONH—, —COO—, —CO—, —$SO_2$—, etc.

The substituted or unsubstituted alkoxy group as represented by $R^{13}$ or $R^{14}$ preferably contains from 1 to 5 carbon atoms and include a methoxy group, an ethoxy group, a 2-sulfoethoxy group, a methoxyethoxy group, etc. The acyl group as represented by $R^{16}$ or $R^{17}$ includes an acetyl group, a propionyl group, etc. The sulfonyl group as represented by $R^{15}$ or $R^{17}$ includes a methanesulfonyl group, an ethanesulfonyl group, etc. The 5- or 6-membered ring formed by $R^{16}$ and $R^{17}$ includes a pyrrolidine ring, a piperidine ring, a morpholine ring, etc.

Specific but non-limiting examples of dye compounds represented by formula (II) according to the present invention are shown below.

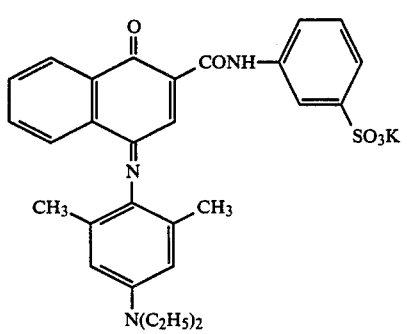

(II-1)

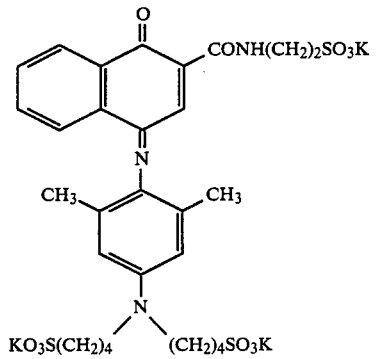

(II-2)

-continued
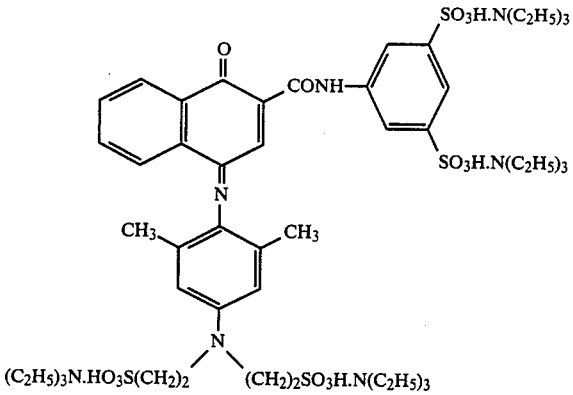
(II-3)
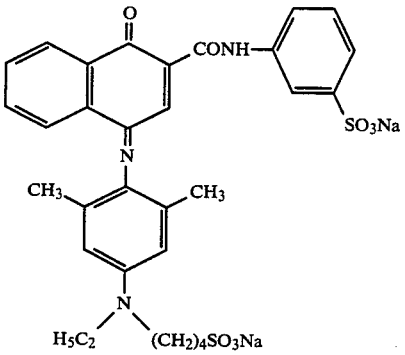
(II-4)
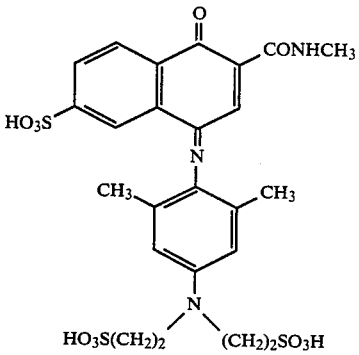
(II-5)
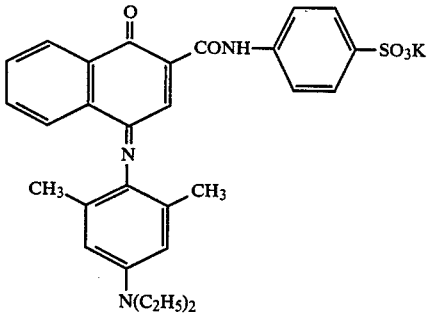
(II-6)
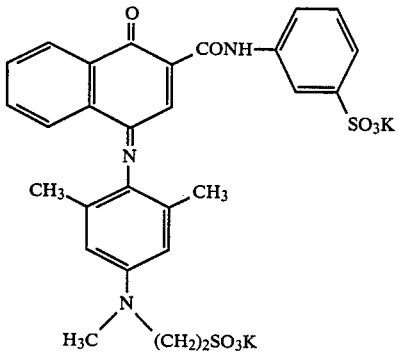
(II-7)
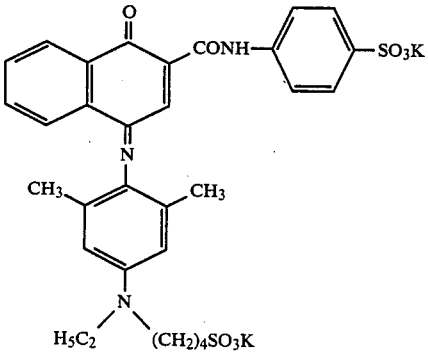
(II-8)
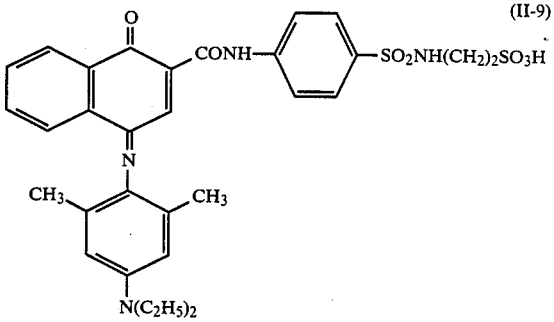
(II-9)

-continued
(II-10)
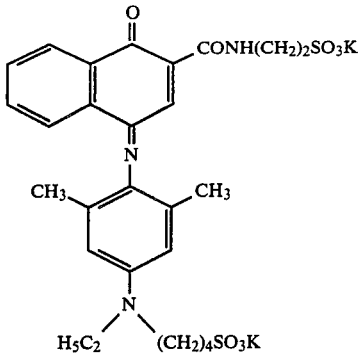
(II-11)
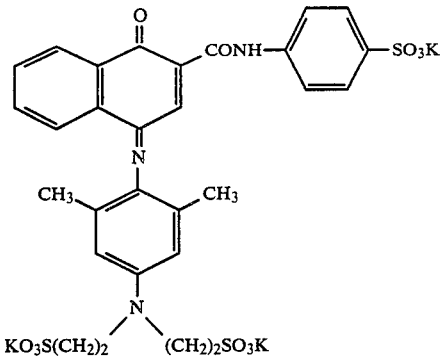
(II-12)
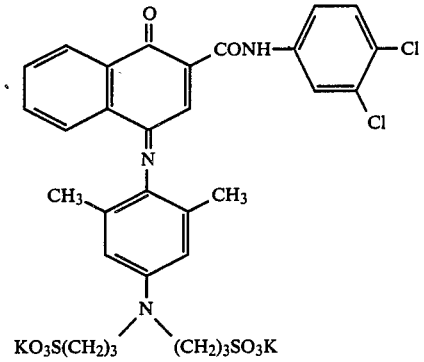
(II-13)
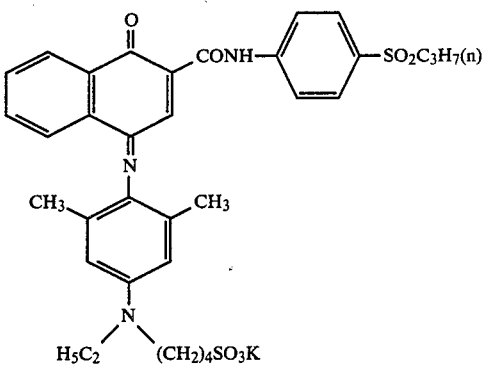
(II-14)
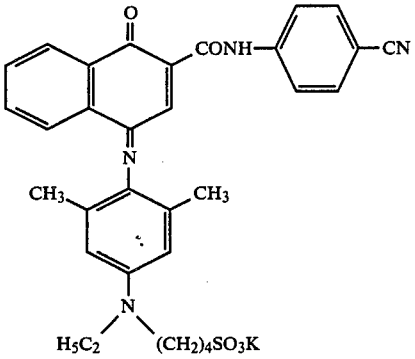
(II-15)
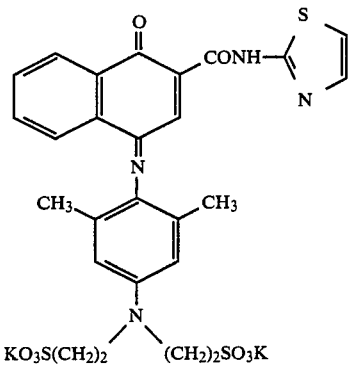
(II-16)
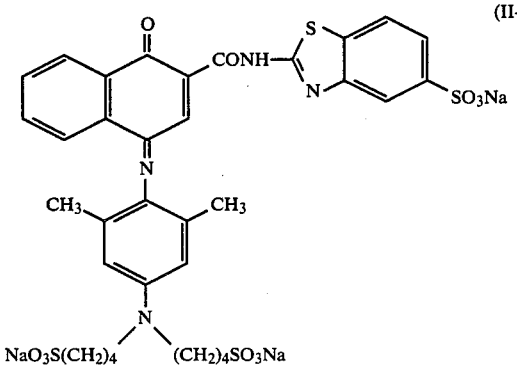
(II-17)
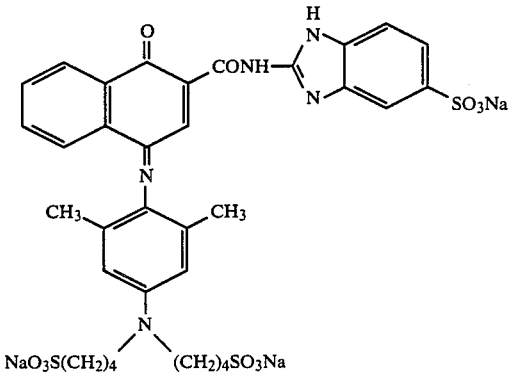

-continued
(II-18)
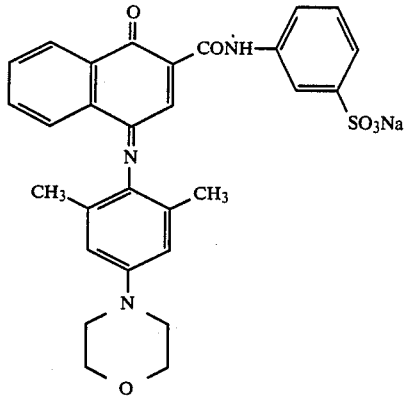
(II-19)
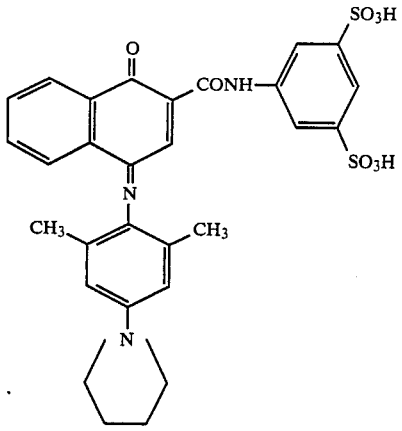
(II-20)
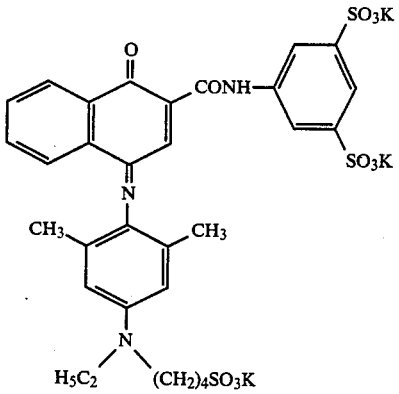
(II-21)
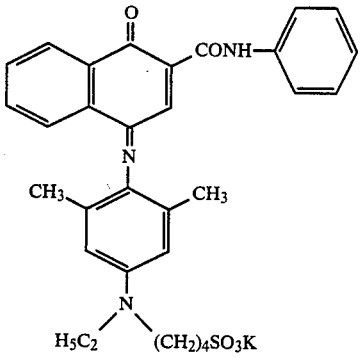
(II-22)
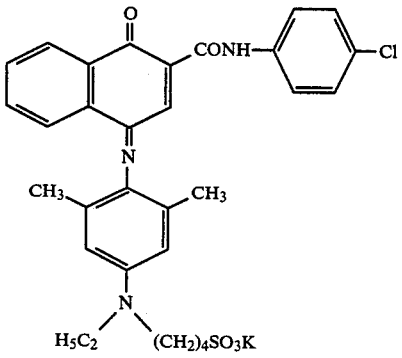
(II-23)
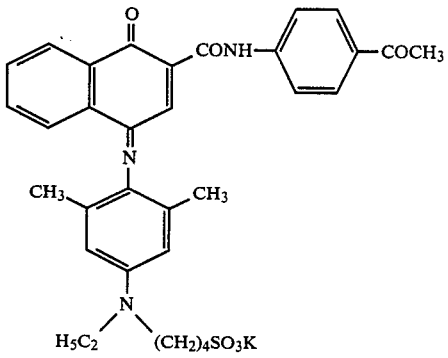
(II-24)
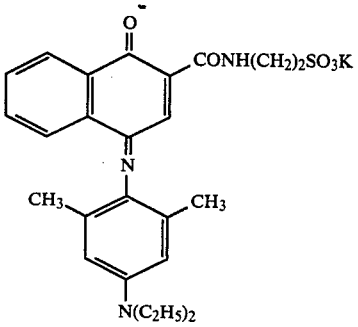
(II-25)
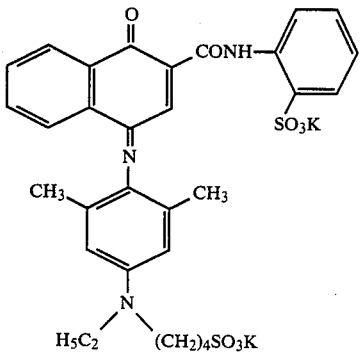

-continued
(II-26)
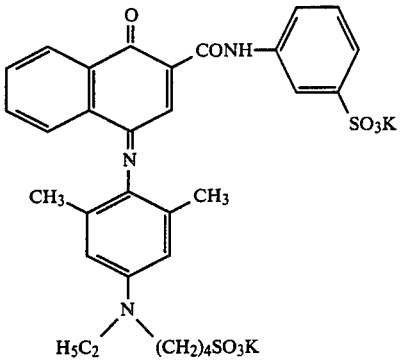
(II-27)
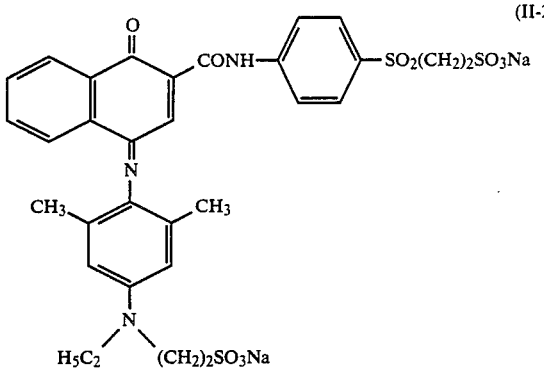
(II-28)
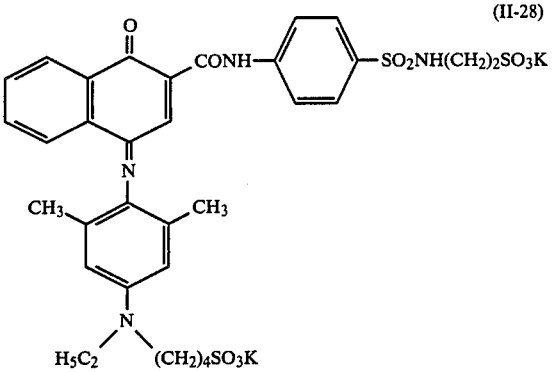
(II-29)
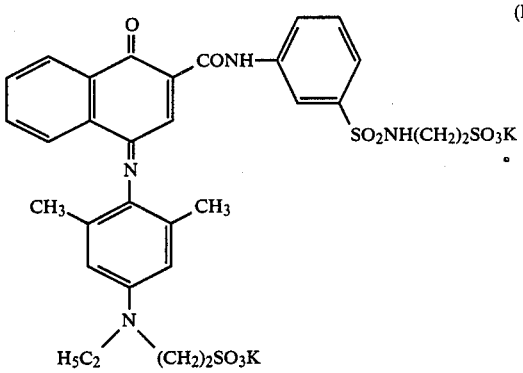
(II-30)
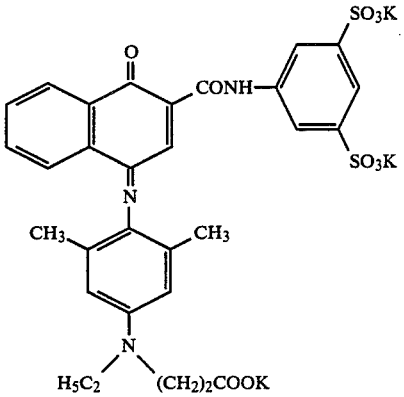
(II-31)
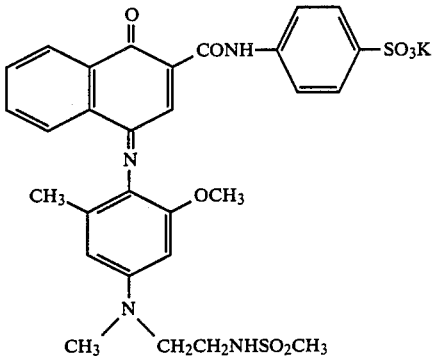
(II-32)
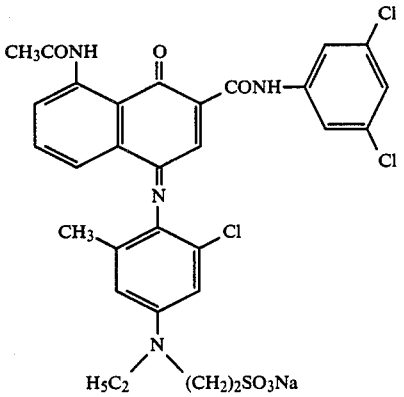
(II-33)
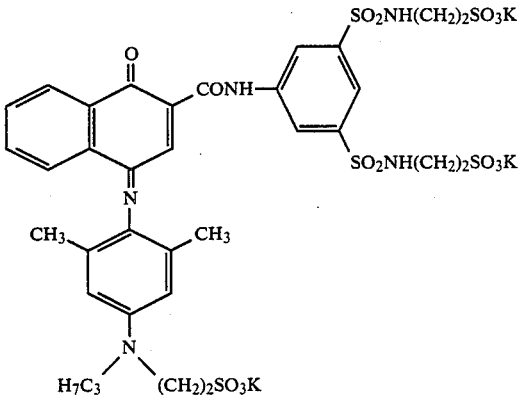

-continued
(II-34)
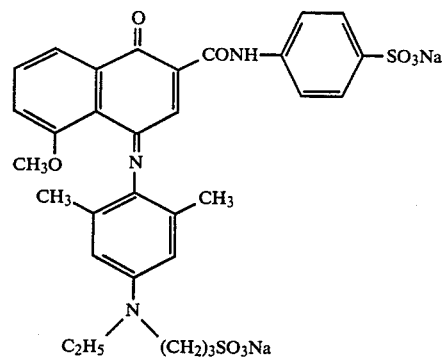
(II-35)
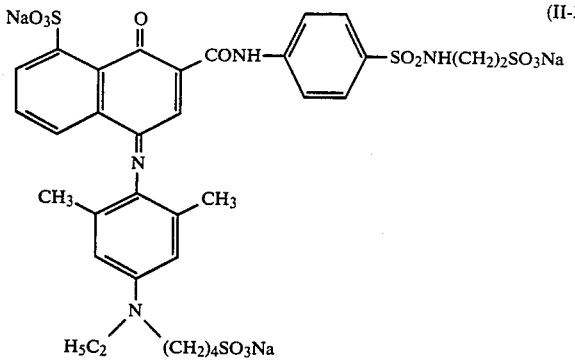
(II-36)
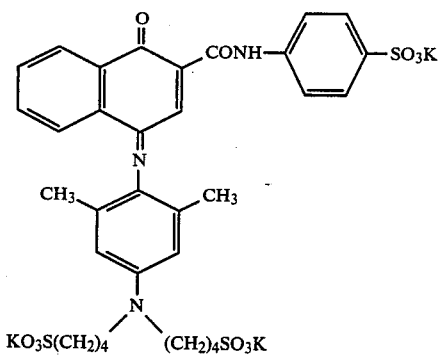
(II-37)
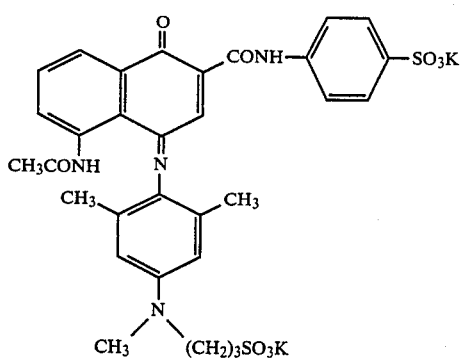
(II-38)
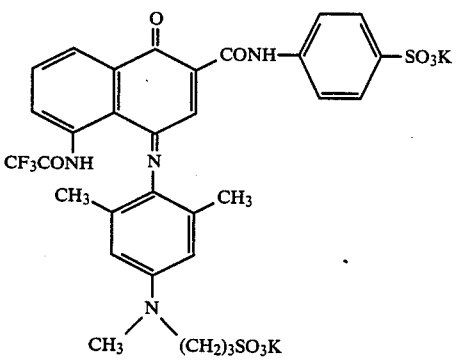
(II-39)
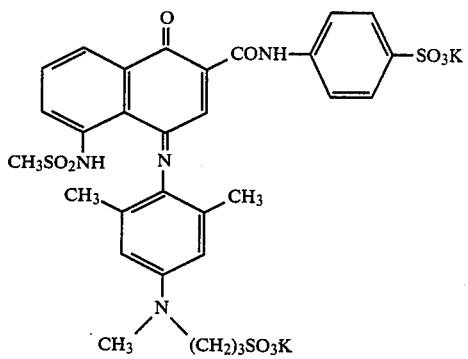
(II-40)
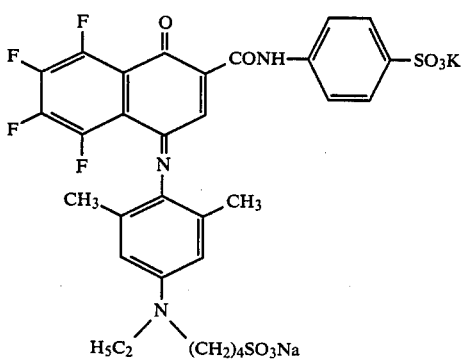
(II-41)
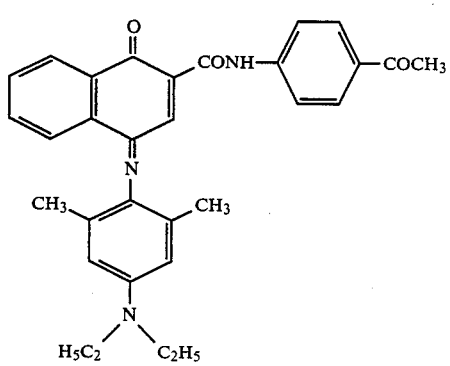

-continued
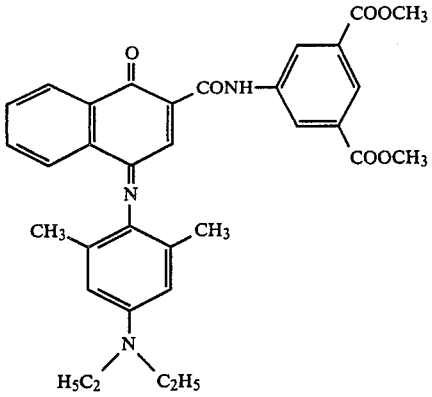
(II-42)
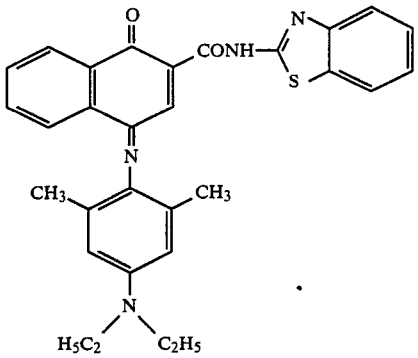
(II-43)
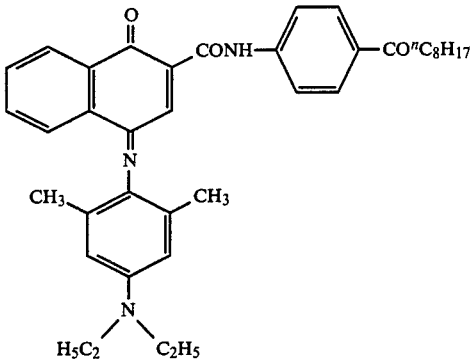
(II-44)
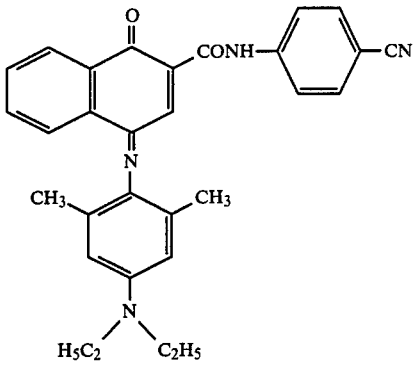
(II-45)
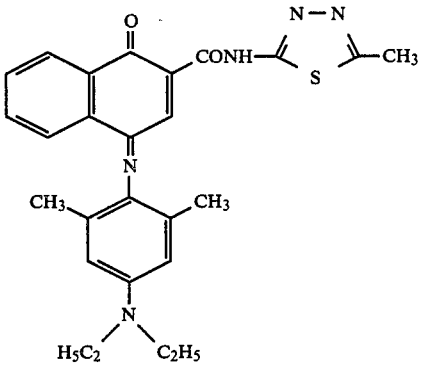
(II-46)
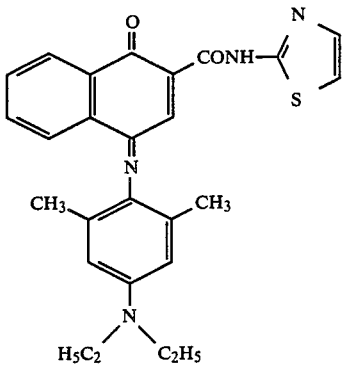
(II-47)
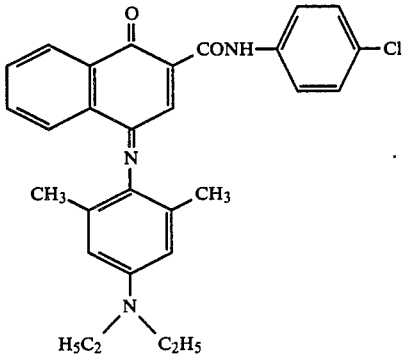
(II-48)
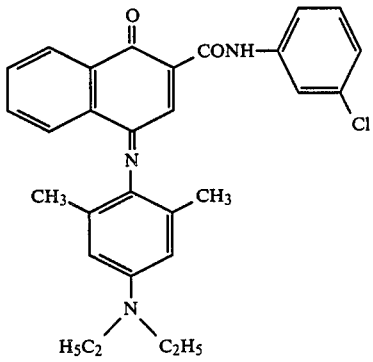
(II-49)

-continued
(II-50)
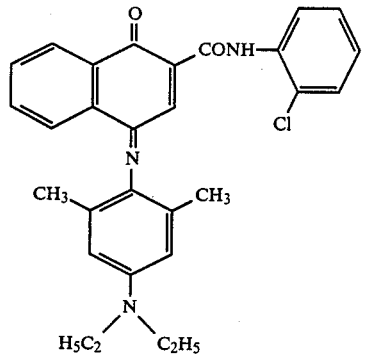
(II-51)
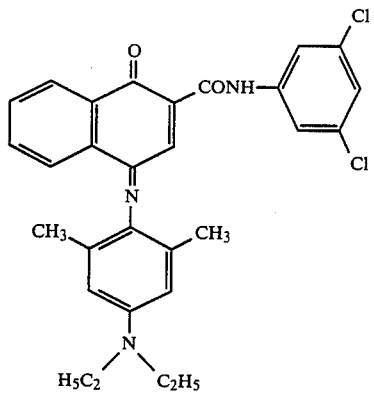
(II-52)
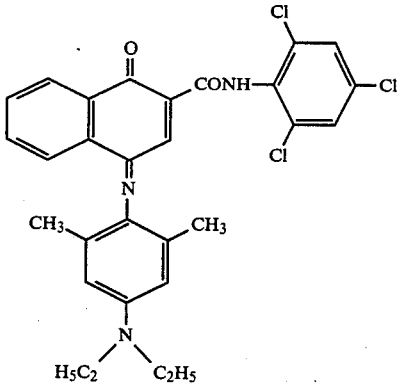
(II-53)
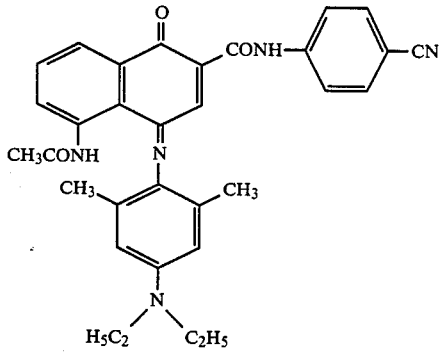
(II-54)
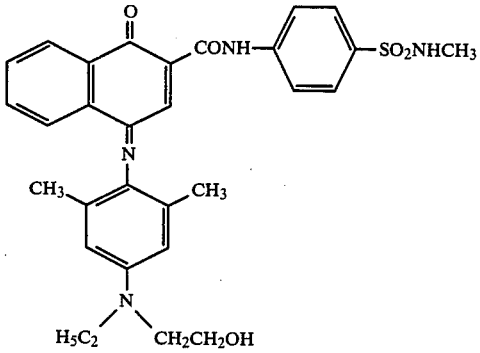
(II-55)
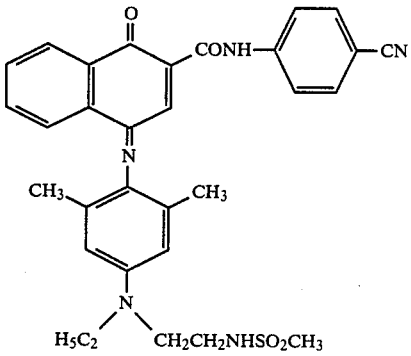
(II-56)
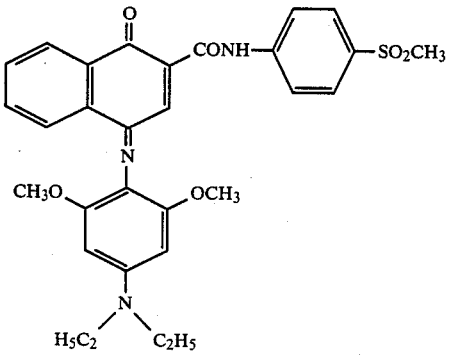
(II-57)
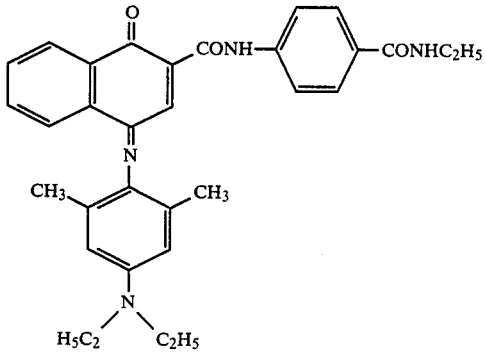

-continued
(II-58)
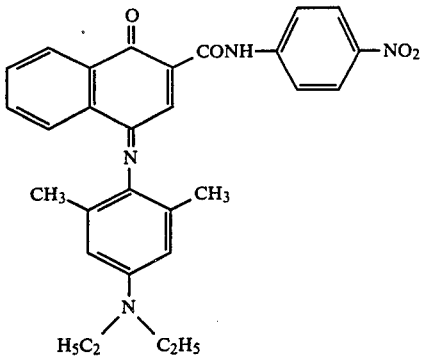
(II-59)
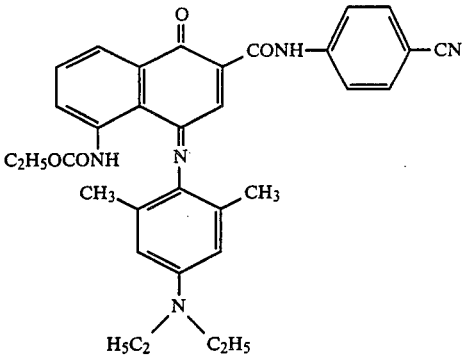
(II-60)
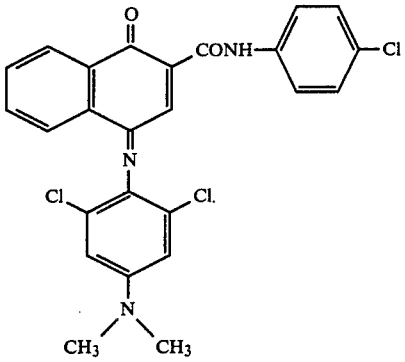
(II-61)
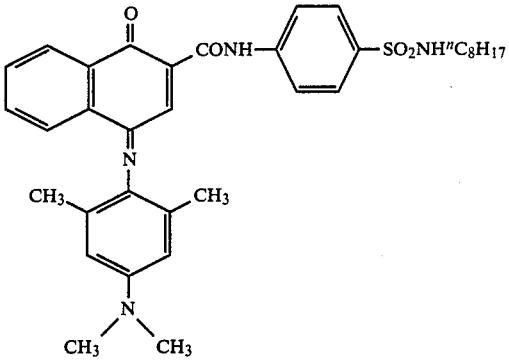
(II-62)
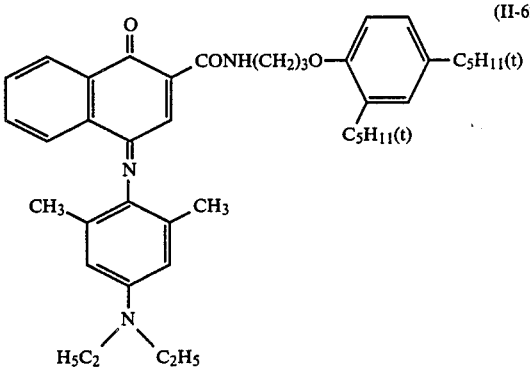
(II-63)
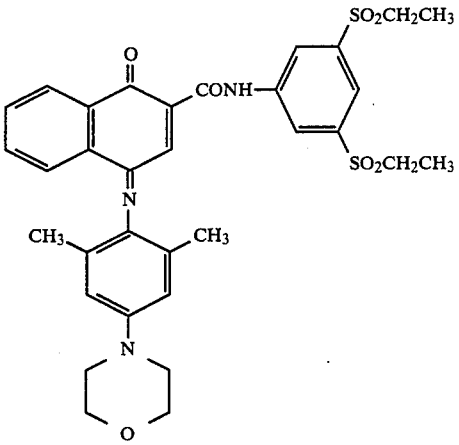
(II-64)
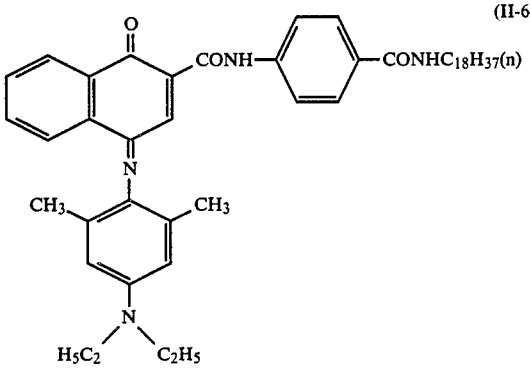
(II-65)
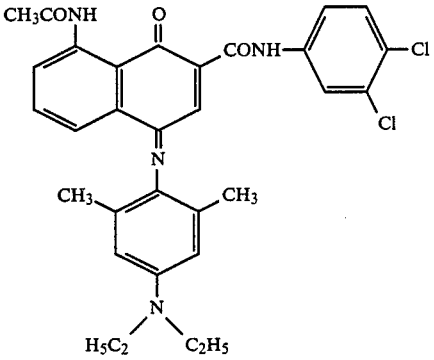

-continued
(II-66)
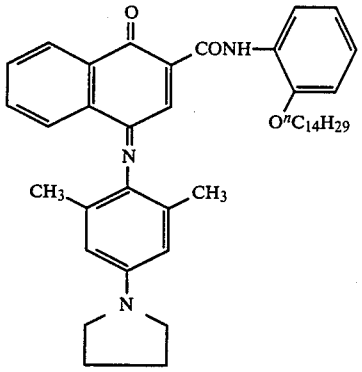
(II-67)
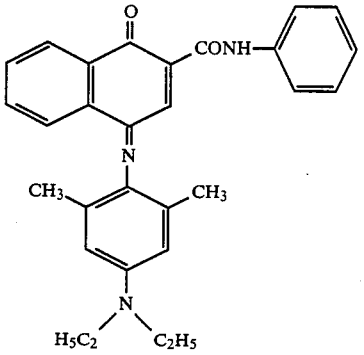
(II-68)
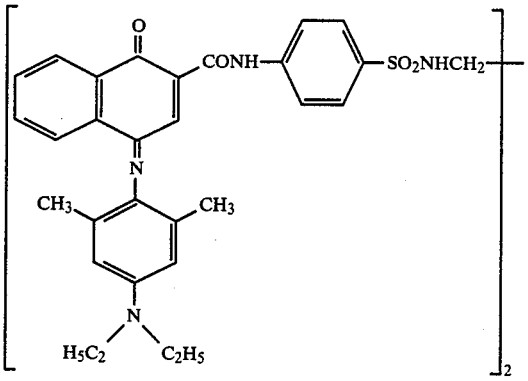
(II-69)
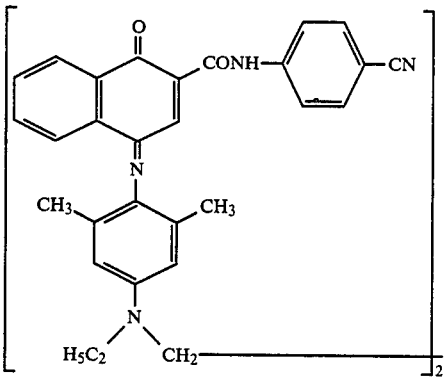
(II-70)
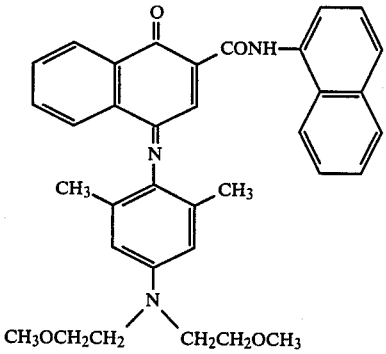
(II-71)
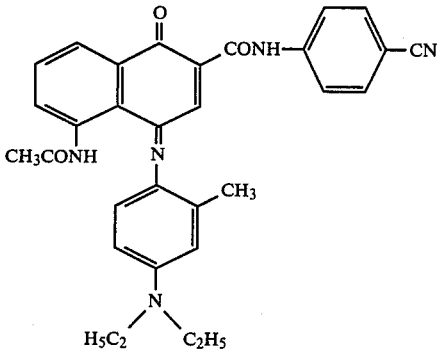
(II-72)
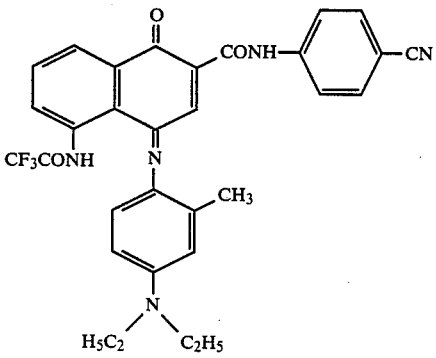
(II-73)
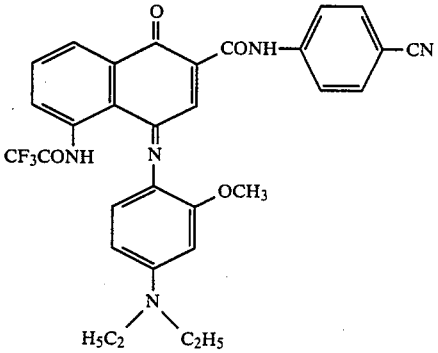

-continued (II-74)

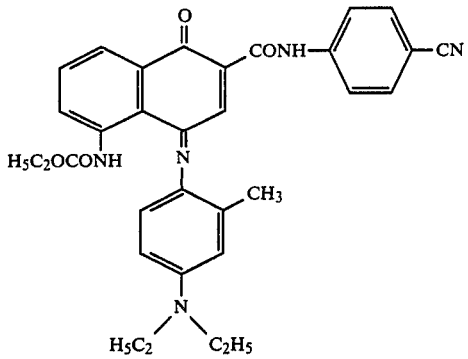

(II-75)

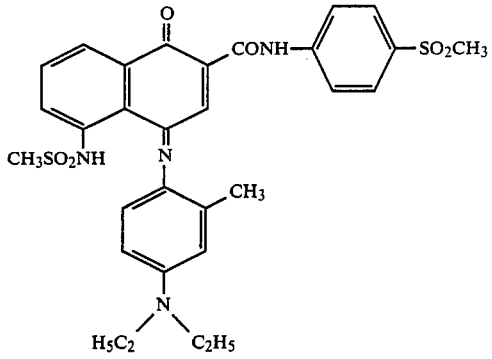

The light absorbing layer according to the present invention can be formed by dissolving or dispersing a near infrared absorbing dye, preferably the dye represented by formula (I) or (II), and a binder in an appropriate solvent, and coating the solution or dispersion on the back side of the conductive support, i.e., the side opposite to the photosensitive layer. The light absorbing layer may be formed either before or after the formation of the photosensitive layer, or these two layers may be formed simultaneously.

The solvents and binders which can be used in the above-described light scattering layer can also be applied to the light absorbing layer.

The near infrared absorbing dye is preferably used in an amount of from 0.1 to 50% by weight, more preferably 0.1 to 30% by weight, based on the total weight of the light absorbing layer. The thickness of the light absorbing layer is preferably from 1 to 20 μm, and more preferably from 1 to 5 μm. The light absorbing layer should have light-transmitting properties to such an extent that it does not cause a hindrance to reading of a toner image formed on the photosensitive layer by means of transmitted light.

The light-transmitting electrophotographic photoreceptors according to the present invention are applicable, e.g., to image formation systems using a semiconductor laser, particularly a semiconductor laser having an emission wavelength of 750 nm or more, as a light source. Electrophotographic image formation by means of the photoreceptor of the present invention comprises charging the surface of the photoreceptor on desired areas, forming an electrostatic latent image by scanning a semiconductor laser, subjecting the latent image to toner development, and fixing the toner to form a toner image. The charging, development, and fixation can be carried out by known means.

The photoreceptors according to the present invention are suitable for use as recording materials, such as microfilms. Whenever necessary, the images recorded on the photoreceptor of the invention can be projected on a screen by transmitted light or copied by means of an appropriate printer.

The invention is now illustrated in greater detail with reference to the following examples, but it should be understood that they are not intended to limit the present invention.

EXAMPLE 1

| | |
|---|---|
| Hydrophobic silica (Aerosil R972, produced by Nippon Aerosil K. K.) | 0.96 g |
| Polycarbonate (Panlite K1300, produced by Teijin Limited) | 19.2 g |
| Linear polyester resin (Vylon 200, produced by Toyo Spinning Co., Ltd.) | 4.8 g |
| Cyclohexanone | 64 ml |
| Methylene chloride | 230 ml |

The above components were dispersed in a homogenizer at 10,000 rpm for 30 minutes to prepare a coating composition for a light scattering layer. A 100 μm thick polyethylene terephthalate film having an indium oxide deposited film was coated with the coating composition on the side opposite to the deposited film, followed by drying to obtain a transparent conductive film having a light scattering layer of 4 μm in thickness on its back side.

A photosensitive composition having the following formulation was coated on the side opposite to the light scattering layer and dried to prepare Electrophotographic Film No. 1 having a 8.7 μm thick photoconductive layer.

| Formulation of Photosensitive Composition: | |
|---|---|
| 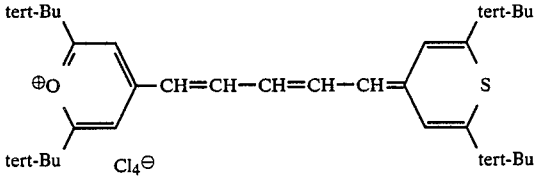 | 2.83 mg ($5 \times 10^{-6}$ mol) |
| N,N'—Diphenyl-N,N'—bis(3-methylphenyl)-[1,1'-biphenyl]-4,4-diamine | 0.3 g |
| Panlite K1300 | 0.5 g |
| Vylon 200 | 0.01 g |

-continued

| Formulation of Photosensitive Composition: | |
|---|---|
| 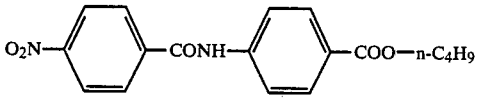 | 64 mg ($1.9 \times 10^{-4}$ mol) |
| Dichloromethane | 4 ml |

COMPARATIVE EXAMPLE 1

For comparison, Electrophotographic Film No. 2 was prepared in the same manner as described in Example 1, except that no light scattering layer was formed.

Each of Film Nos. 1 and 2 was positively charged and exposed to light by the use of a scanning exposure machine having a Ga-Al-As semiconductor laser (wavelength of emission spectrum: 780 nm; output: 5 mW). The resulting latent image was developed with a negatively charged liquid toner. As a result, a sharp image having a uniform density of the solid areas was obtained on Film No. 1. The image on Film No. 1 could be seen by means of transmitted light without any substantial problem. Whereas, Film No. 2 provided an unclear image with non-uniformity of density, viz., interference fringes, on its solid areas.

EXAMPLE 2

Electrophotographic Film No. 3 was prepared in the same manner as described in Example 1 except for using a photosensitive composition having the following formulation.

| Formulation of Photosensitive Composition: | |
|---|---|
| 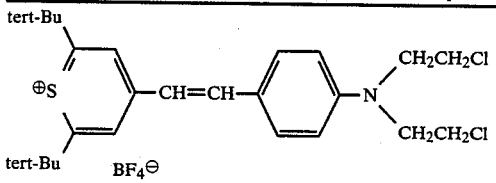 | 322 mg ($6 \times 10^{-4}$ mol) |
| N,N'—Diphenyl-N,N'—bis(3-methylphenyl)-[1,1'-biphenyl]-4,4-diamine | 36 g |
| Panlite K1300 | 60 g |
| Vylon 200 | 1.2 g |
| 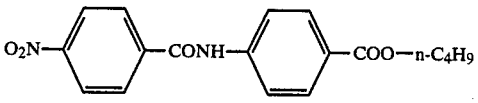 | 7.68 g |
| Dichloromethane | 500 ml |

COMPARATIVE EXAMPLE 2

For comparison, Electrophotographic Film No. 4 was prepared in the same manner as described in Example 2 except for forming no light scattering layer.

Each of Film Nos. 3 and 4 was positively charged, exposed to light by the use of a scanning exposure machine having an He-Ne laser (wavelength of emission spectrum: 633 nm; output: 5 mW), and then developed with a negatively charged liquid toner.

As a result, a sharp image with a uniform density of the solid areas was formed on Film No. 3. The image on Film No. 3 could be observed by means of transmitted light without any substantial problem. Whereas, the image formed on Film No. 4 was unclear and had non-uniformity of density, i.e., interference fringes, on its solid areas.

EXAMPLE 3

A 100 μm thick polyethylene terephthalate film having an indium oxide deposited film was coated with a subbing layer having the following formulation on the side opposite to the deposited film, followed by drying at 180° C. for 1 minute.

| Formulation of Subbing Layer: | |
|---|---|
| Butadiene-styrene-acrylic acid copolymer latex (35:63:2 by weight; solid content: 50% by weight) | 10 ml |
| 2,4-Dichloro-6-hydroxy-s-triazine sodium salt (8 wt % solution) | 2 ml |
| Distilled water | 150 ml |

Fifty grams of gelatin was dissolved in water, and 1.5 g of Compound (I-1) was added to the solution. Then, 30 ml of a 4 wt% aqueous solution of sodium dodecylbenzenesulfonate as a surface active agent and 45 ml of a 1 wt% aqueous solution of 1-hydroxy-3,5-dichlorotriazine sodium salt as a hardening agent were added thereto to make one liter. The resulting gelatin-containing aqueous solution was coated on the above-described subbing layer to a dry thickness of 5 μm to prepare a transparent conductive film having provided thereon a light absorbing layer.

A photosensitive composition having the following formulation was then coated on the side opposite to the light absorbing layer, i.e., on the indium oxide film, and dried to prepare Electrophotographic Film No. 5 having a photoconductive layer of about 8 μm in thickness.

| Formulation of Photosensitive Composition: | |
|---|---|
| 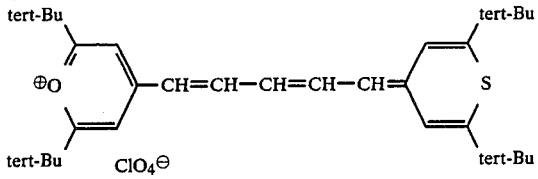 | 2.83 mg ($5 \times 10^{-6}$ mol) |
| N,N'—Diphenyl-N,N'—bis(3-methyl-phenyl)-[1,1'-biphenyl]-4,4-diamine | 0.3 g |
| Panlite K1300 | 0.5 g |
| Vylon 200 | 0.01 g |
| 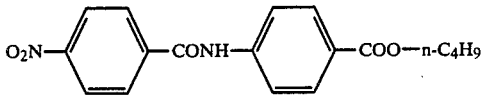 | 64 mg ($1.9 \times 10^{-4}$ mol) |
| Dichloromethane | 4 ml |

COMPARATIVE EXAMPLE 3

For comparison, Electrophotographic Film No. 6 was prepared in the same manner as in Example 3, except for forming no light absorbing layer.

Each of Film Nos. 5 and 6 was positively charged, exposed to light by the use of a scanning exposure machine having a Ga-Al-As semiconductor laser (wavelength of emission spectrum: 780 nm; output: 5 mW), and developed with a negatively charged liquid toner. As a result, a sharp image having a uniform density on the solid areas was formed on Film No. 5. The image on Film No. 5 could be observed by means of transmitted light without any substantial problem. On the other hand, Film No. 6 formed an unclear image with interference fringe-like non-uniformity of density on its solid areas.

EXAMPLE 4

Electrophotographic Film Nos. 7 to 14 were prepared in the same manner as in Example 3 except for replacing Compound (I-1) with the compound shown in Table 1. When these films were processed in the same manner as in Example 3, a sharp image having a uniform density on its solid areas was obtained in every case.

TABLE 1

| Electrophotographic Film No. | Compound No. | Amount of Compound (g) |
|---|---|---|
| 7 | I-8 | 1.5 |
| 8 | I-11 | 1.5 |
| 9 | I-13 | 1.5 |
| 10 | I-29 | 1.5 |
| 11 | II-1 | 15 |
| 12 | II-5 | 15 |
| 13 | II-8 | 15 |
| 14 | II-10 | 15 |

EXAMPLE 5

A 100 μm thick polyethylene terephthalate film having an indium oxide deposited film was coated with a coating composition having the following formulation on the side opposite to the deposited film, followed by drying, to obtain a transparent conductive film having a 4 μm thick light absorbing layer.

| Formulation of Coating Composition: | |
|---|---|
| 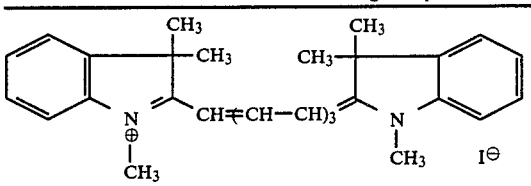 | 0.32 g |
| Panlite K1300 | 16 g |
| Vylon 200 | 4 g |
| Cyclohexanone | 50 ml |
| Methylene chloride | 120 ml |

Then, a photosensitive composition having the same formulation as used in Example 3 was coated on the side opposite to the light absorbing layer, followed by drying to prepare Electrophotographic Film No. 15 having 8 μm thick photoconductive layer. When Film No. 15 was processed in the same manner as in Example 3, a sharp image with a uniform density of the solid areas was obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor for using a laser beam as a light source comprising a light-transmitting conductive support having provided thereon a light-transmitting electrophotographic photosensitive layer, wherein said support is further provided on the side opposite to the photosensitive layer with a light scattering layer comprising an inorganic fine powder and a binder or a light absorbing layer comprising a near infrared absorbing dye and a binder.

2. An electrophotographic photoreceptor as in claim 1, wherein said in organic fine powder is selected from zinc oxide, titanium oxide, aluminum oxide, silicon oxide, zirconium oxide, antimony oxide, tin oxide, indium oxide, silicon carbide, titanium carbide, boron nitride, tantalum nitride, titanium nitride, magnesium fluoride, and cerium fluoride.

3. An electrophotographic photoreceptor as in claim 1, wherein said binder is a compound selected from gelatin, polyamide, polyurethane, polyester, an epoxy resin, polyketone, a styrene polymer or copolymer, poly-N-vinylcarbazole, polycarbonate, polyester carbonate, polysulfone, a vinyl chloride resin, a vinylidene chloride resin, a vinyl acetate resin, and an acrylic resin.

4. An electrophotographic photoreceptor as in claim 1, wherein said near infrared absorbing dye is selected from cyanine dyes, methine dyes, naphthoquinone dyes, and squalilium dyes.

5. An electrophotographic photoreceptor as in claim 4, wherein said near infrared absorbing dye is a compound represented by formula (I)

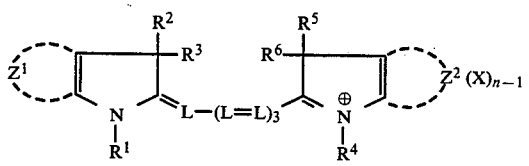

wherein $R^1$, $R^2$, $R^3$, $R^4$, $R^5$, and $R^6$ each represents a substituted or unsubstituted alkyl group; $Z^1$ and $Z^2$ each represents a non-metallic atomic group forming a substituted or unsubstituted benzene or naphthalene condensed ring; L represents a substituted or unsubstituted methine group; X represents an anion; and n represents 1 or 2; when n is 1, the compound is an inner salt; provided that at least one of $R^1$, $R^2$, $R^3$, $R^4$, $R^5$, $R^6$, $Z^1$, and $Z^2$ has an acid radical as a substituent.

6. An electrophotographic photoreceptor as in claim 5, wherein said compound contains from 4 to 6 sulfonic acid groups per molecule.

7. An electrophotographic photoreceptor as in claim 5, wherein $R^1$ and $R^4$ each represents a sulfo-substituted alkyl group having from 1 to 5 carbon atoms.

8. An electrophotographic photoreceptor as in claim 4, wherein said near infrared absorbing dye is a compound represented by formula (II)

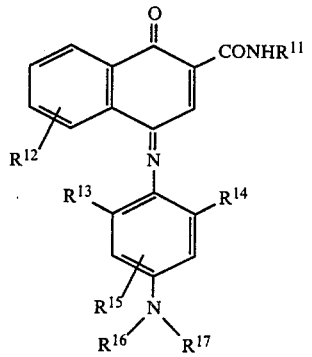

wherein $R^{11}$ represents a substituted or unsubstituted alkyl group, a substituted or unsubstituted aryl group, or a substituted or unsubstituted heterocyclic group; $R^{12}$ and $R^{15}$ each represents a hydrogen atom or a group capable of substituting for a hydrogen atom; $R^{13}$ and $R^{14}$ each represents a hydrogen atom, a halogen atom, a substituted or unsubstituted alkoxy group, or a substituted or unsubstituted alkyl group, provided that $R^{13}$ and $R^{14}$ do not simultaneously represent hydrogen atoms; and $R^{16}$ and $R^{17}$ each represents a substituted or unsubstituted alkyl group, a substituted or unsubstituted aryl group, an acyl group, or a sulfonyl group, or $R^{16}$ and $R^{17}$ together form a non-metallic 5- or 6-membered ring.

9. An electrophotographic photoreceptor as in claim 1, wherein said inorganic fine powder has a particle size of from 7 to 200 μm.

10. An electrophotographic photoreceptor as in claim 1, wherein the inorganic fine powder is present in an amount of from 1 to 70% by weight based on the total weight of the light scattering layer.

11. An electrophotographic photoreceptor as in claim 1, wherein said near infrared absorbing dye is present in an amount of from 0.1 to 50% by weight based on the total weight of the light absorbing layer.

12. An electrophotographic photoreceptor as in claim 1, wherein said light scattering layer or light absorbing layer has a thickness of from 1 to 20 μm.

13. An electrophotographic photoreceptor as in claim 1, wherein said light scattering layer or light absorbing layer has a thickness of from 1 to 5 μm.

* * * * *